US005301925A

United States Patent [19]

Carlson

[11] Patent Number: 5,301,925

[45] Date of Patent: Apr. 12, 1994

[54] DEPRESSED WATERWAY FENCE AND METHOD OF USE THEREOF

[76] Inventor: Eric Carlson, Rte. 2, Box 65, Ottumwa, Iowa 52501

[21] Appl. No.: 966,420

[22] Filed: Oct. 26, 1992

[51] Int. Cl.[5] ..... E01F 7/00; E04H 17/14

[52] U.S. Cl. ..... 256/13; 256/32; 256/DIG. 2

[58] Field of Search ..... 256/13, DIG. 2, 12.5, 256/32

[56] References Cited

U.S. PATENT DOCUMENTS

| | | | |
|---|---|---|---|
| 133,795 | 12/1872 | Nichols | 256/13 |
| 286,182 | 10/1883 | Cunningham et al. | 256/13 |
| 1,034,248 | 7/1912 | Keck et al. | 256/13 X |
| 2,329,259 | 10/1941 | Freeman . | |
| 2,766,017 | 9/1955 | Cote . | |
| 2,895,716 | 1/1957 | Veltri . | |
| 3,347,527 | 10/1967 | Andrews | 256/12.5 |
| 3,473,786 | 10/1969 | Luebke | 256/12.5 |

FOREIGN PATENT DOCUMENTS

| | | | |
|---|---|---|---|
| 5319 | of 1915 | United Kingdom | 256/13 |

*Primary Examiner*—Randolph A. Reese
*Assistant Examiner*—Christopher J. Novosad
*Attorney, Agent, or Firm*—Zarley, McKee, Thomte, Voorhees, & Sease

[57] ABSTRACT

A fence for a depressed waterway has a pair of anchor posts normally located on opposite sides of the waterway. At least one ground anchor is positioned between the anchor posts in the bottom of the waterway. A wire fence extends between the anchor posts and over the ground anchor. A vertical post is secured to the wire and is suspended by the wire above the ground anchor. The vertical post has a lower end detachably secured to the ground anchor so that the lower end of the vertical posts will disengage the ground anchor and will tilt on said wires in a downstream direction when encountered by debris under flooded conditions. The method of use of a waterway fence comprises placing opposite fence anchor posts on opposite sides of the waterway. At least one ground anchor is placed in the waterway below the normal vertical plane of the fence to be built. The fence wire extends between the anchor posts and over the waterway. A vertical post is secured to the wire above the ground anchor and is suspended by the wire, and is detachably secured by its lower end to the ground anchor. The lower end of the suspended post disengages the ground anchor and tilts in a downstream direction when impacted by debris under flooded conditions. The suspended post is held in its detachable connection with the ground anchor by the spring tension in the fence wire.

13 Claims, 1 Drawing Sheet

DEPRESSED WATERWAY FENCE AND METHOD OF USE THEREOF

BACKGROUND OF THE INVENTION

It is often necessary to build fences across depressed waterways or ravines in livestock grazing areas. These fences can be comprised of woven wire fence material, or separate strands of elongated barbed wire material, suspended on a plurality of posts imbedded in the banks and on the bottom of the waterway.

Such fences are very susceptible to being damaged, washed out, or destroyed when high water rushes down the waterway from typical rainstorms. The water and debris in the water exert a substantial force on such fences which are normally built at right angles to the waterway, and the combined effect of the water and the debris in the water are likely to damage the wire or the post and often will either dislodge the post from the ground or the wire from the post.

It is therefore a principal object of this invention to provide a waterway fence and a method of use thereof which will permit such fences to survive even severe flooding conditions.

A further object of this invention is to provide a waterway fence that is easy to install.

A still further object of this invention is to provide a waterway fence that will yield to the onrushing flooding water and debris to permit the debris to pass underneath the fence.

A still further object of this invention is to provide a waterway fence that will yield to the onrushing water, but which can be reinstated as a viable livestock fence when the water recedes.

These and other objects will be apparent to those skilled in the art.

SUMMARY OF THE INVENTION

This invention comprises a fence for a depressed waterway. The fence is comprised of a pair of anchor posts normally located on opposite sides of the waterway. At least one ground anchor is positioned between the anchor posts in the bottom of the waterway. A wire fence extends between the anchor posts and over the ground anchor. A vertical post is secured to the wire and is suspended by the wire above the ground anchor. The vertical post has a lower end detachably secured to the ground anchor so that the lower end of the vertical posts will disengage the ground anchor and will tilt on said wires in a downstream direction when encountered by debris under flooded conditions.

The method of this invention comprises placing opposite fence anchor posts on opposite sides of the waterway. At least one ground anchor is placed in the waterway below the normal vertical plane of the fence to be built. The fence wire extends between the anchor posts and over the waterway. A vertical post is secured to the wire above the ground anchor and is suspended by the wire, and is detachably secured by its lower end to the ground anchor. The lower end of the suspended post disengages the ground anchor and tilts in a downstream direction when impacted by debris under flooded conditions. The suspended post is held in its detachable connection with the ground anchor by the spring tension in the fence wire.

DESCRIPTION OF THE PREFERRED EMBODIMENT

Figure 1:
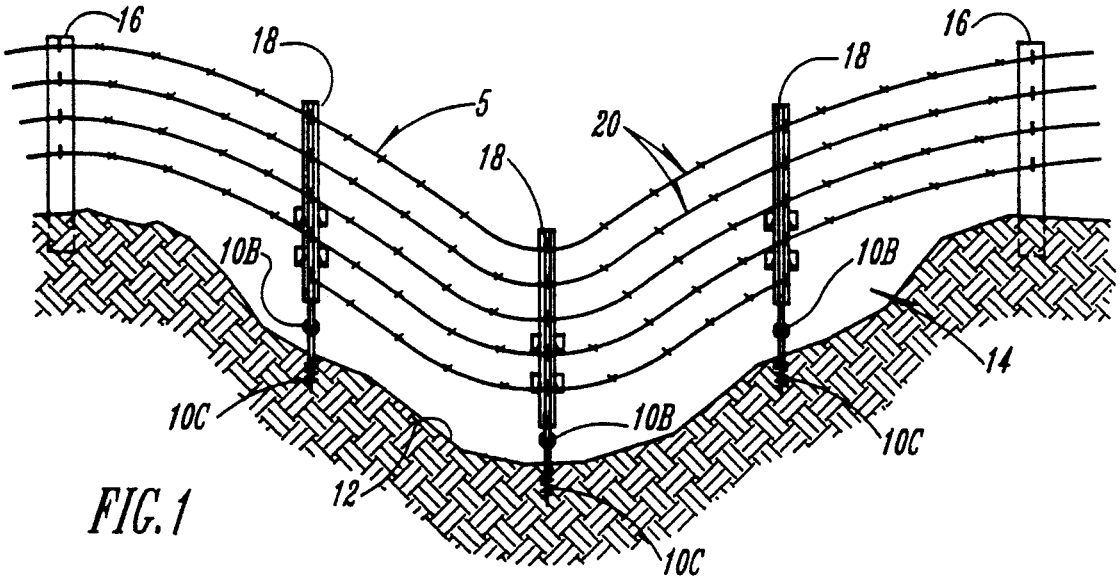
FIG. 1 is a partial sectional view through a waterway or a ravine showing the fence of this invention mounted therein.
Figure 4:
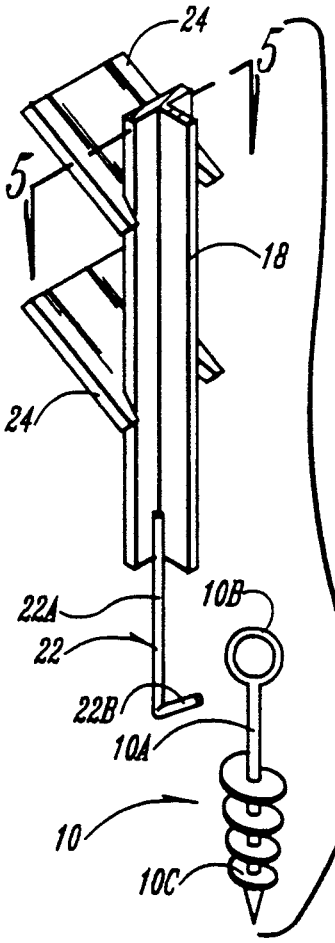
FIG. 4 is a partial perspective exploded view of the lower end of the suspended post and the ground anchor.
Figure 5:
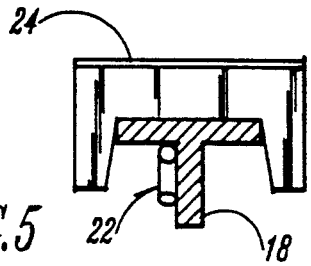
FIG. 5 is an enlarged scale sectional view taken on line 5—5 of FIG. 4.

The fence of this invention is generally denoted by the numeral 5 as best seen in FIG. 1 of the drawings. Ground anchors 10 are secured to the bed 12 of ravine or waterway 14. Ground anchors 10, as best seen in FIG. 4, are comprised of shaft 10A, eyelet 10B on the upper end thereof, and screw flighting 10C on the lower end thereof. As seen in FIG. 1, the eyelet 10 is positioned to be perpendicular to the direction or flow of water down the ravine.

Anchor posts 16 are conventionally secured in the ground on opposite side edges of the waterway 14. Ravine posts 18 are suspended on wires 20 which extend between anchor posts 16. Any number of ravine posts 18 can be used to span the breadth of the waterway 14.

Secured to the lower ends of ravine posts 18 are hooks 22 which are comprised of shanks 22A, and lip elements 22B. Lip elements 22B are inserted into the eyelets 10B of ground anchors 10. The lip elements 22B are bent upwardly at an angle with respect to the vertical shank 22A. This angle should be between 30 and 45 degrees.

Figure 3:
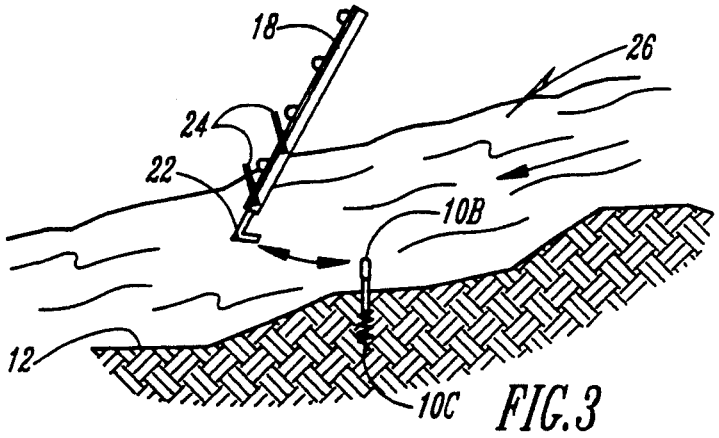
FIG. 3 is a view similar to that of FIG. 2 but shows the fence in its detached position with respect to the ground anchor under flooded conditions.

As shown in FIG. 4, one or more deflector plates 24 are welded or otherwise secured to the ravine posts 18. The plates extend downwardly at an angle of about 45 degrees with respect to the longitudinal axis of the posts. The plates 24 are secured to the downstream side of the posts so that an oncoming rush of water will tend to move the posts 14 vertically downwardly as the water impacts the plates. As the ravine posts are forced downwardly, the lip elements 22B move downwardly and outwardly in a downstream direction to disengage the eyelets 10B of ground anchors 10. This will cause the fence 5 to tilt in a downstream direction as best shown in FIG. 3. In this tilted condition, the water and most of the debris in the water will tend to pass underneath the fence.

Figure 2:
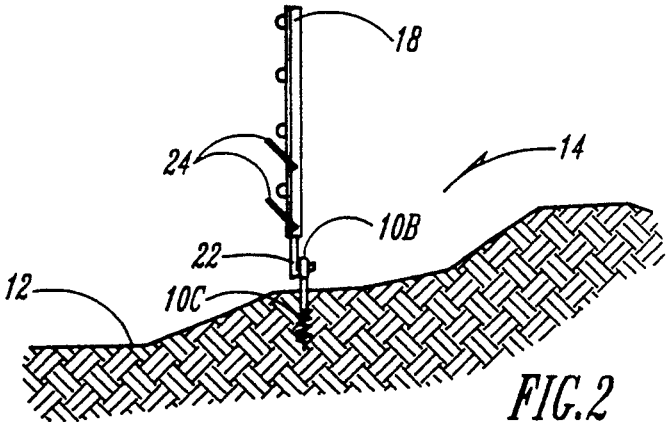
FIG. 2 is a sectional view taken at right angles to the view of FIG. 1 on line 2—2 of FIG. 1.

When the water flow 26 recedes, the hooks 22B can be reinserted in the eyelets 10B of ground anchors 10 so that the fence can be restored to its operative state as shown in FIGS. 1 and 2.

It is therefore seen that the device and method of this invention will achieve their stated objectives.

I claim:

1. The method of laterally fencing a depressed waterway so as to permit a fence in the waterway dwelling normally in a vertical plane with respect to a level horizontal plane on the earth's surface to survive a flood in the waterway consisting of downstream movable debris-filled water, comprising, placing opposite fence anchor posts on opposite sides of said waterway, placing at least one ground anchor in said waterway below the normal vertical plane of the fence to be built, stretching fence wire over said waterway between said anchor posts, suspending a post having a lower end to said fence wire above said ground anchor, and detachably securing the lower end of said suspended post to said ground anchor so that the lower end of said suspended post will disengage said ground anchor and will tilt on said wires in a down stream direction when encountered by debris under flooded conditions.

2. The method of claim 1 wherein said suspended post is forced downwardly by said debris-filled water to effect disengagement with said ground anchor.

3. The fence of claim 1 wherein spring tension in said fence wire detachably holds said vertical post therefore to said ground anchor.

4. A fence for a depressed waterway, comprising, a pair of anchor posts on opposite sides of said waterway, at least one ground anchor between said anchor posts, fence wire extending between said anchor posts and over said ground anchors, a vertical post secured to said wire and suspended by said wire above said ground anchor; said vertical post having a lower end detachably secured to said ground anchor so that the lower end of said vertical post will disengage said ground anchor and will tilt on said wires in a down stream direction when encountered by debris under flooded conditions.

5. The fence of claim 4 wherein said vertical post is provided with means to induce downward movement of said vertical post in a flowing current of water to effect disengagement of said vertical post from said ground anchor.

6. The fence of claim 5 wherein a deflector plate is secured to said vertical post and disposed at an angle therewith to cause said post to move downward when facing an oncoming current of water.

7. The fence of claim 6 wherein said deflector plate slopes downwardly and forwardly with respect to the upstream side of said fence.

8. The fence of claim 4 wherein said ground anchor is an elongated rod with screw flighting on its lower end and an eyelet on its upper end.

9. The fence of claim 8 wherein a hook member is secured to the lower end of said vertical post, and said hook member is detachably secured to said eyelet on said ground anchor.

10. The fence of claim 4 wherein a hook member is secured to the lower end of said vertical post, and said hook member is detachably secured to said ground anchor.

11. The fence of claim 10 wherein spring tension in said fence wire detachably holds said hook member to said ground anchor.

12. The fence of claim 10 wherein said hook member has a vertical portion and a lip portion bent at an angle of less than 90° with respect to said vertical portion.

13. A fence for a depressed waterway, comprising, a pair of anchor posts on opposite sides of said waterway, at least one ground anchor between said anchor posts, fence wire extending between said anchor posts and over said ground anchors, a vertical post secured to said wire and suspended by said wire above said ground anchor; said vertical post having a lower end comprising means for detachably securing said vertical post to said ground anchor so that the lower end of said vertical post will tilt on said wires in a down stream direction when encountered by debris under flooded conditions.

* * * * *